United States Patent [19]

McCahill

[11] Patent Number: 4,856,578

[45] Date of Patent: Aug. 15, 1989

[54] MULTI-FUNCTION SELF-CONTAINED HEAT PUMP SYSTEM

[75] Inventor: David I. McCahill, Champion, Pa.

[73] Assignee: Nepco, Inc., Monroeville, Pa.

[21] Appl. No.: 186,231

[22] Filed: Apr. 26, 1988

[51] Int. Cl.[4] ..... F25B 29/00

[52] U.S. Cl. ..... 165/29; 62/201; 62/238.7; 62/324.6

[58] Field of Search ..... 62/238.7, 238.6, 160, 62/201 X, 203, 324.6; 237/2.8; 165/29

[56] References Cited

U.S. PATENT DOCUMENTS

| | | | |
|---|---|---|---|
| 2,934,913 | 5/1960 | Haines et al. | 62/203 X |
| 4,256,475 | 3/1981 | Schafer | 62/238.7 |
| 4,592,206 | 6/1986 | Yamazaki et al. | 62/324.6 |
| 4,646,537 | 3/1987 | Crawford | 62/238.5 |
| 4,693,089 | 9/1987 | Bourne et al. | 62/238.7 |

*Primary Examiner*—William E. Wayner

*Attorney, Agent, or Firm*—Webb, Burden, Ziesenheim & Webb

[57] ABSTRACT

A heat pump unit capable of producing hot potable water irregardless of the heating or cooling operation of the heat pump. The heat pump for heating or cooling a conditioned space with potable water heating capability. The heat pump unit having a compressor with a service port, an entrance port and a discharge. A three-way valve is provided connected to the discharge and to the service port of the compressor, and reversing valve is connected to the three-way valve and to the compressor entrance port. A refrigerant-air heat exchanger is connected to the reversing valve outlet and an external source-refrigerant heat exchanger is connected to the reversing valve with a refrigerant-potable water heat exchanger connected to the three-way valve. The heat pump unit also includes a refrigerant-control device interposed between the external source-refrigerant heat exchanger and the refrigerant-air heat exchanger, a first bi-flow valve interposed between the refrigerant-control device and the refrigerant-potable water heat exchanger, and a second bi-flow valve interposed between the refrigerant-control device and the refrigerant-potable water heat exchanger produces hot water irregardless of the heating or cooling operation of the heat pump.

34 Claims, 6 Drawing Sheets

MULTI-FUNCTION SELF-CONTAINED HEAT PUMP SYSTEM

BACKGROUND OF THE INVENTION

1. Field of the Invention

This invention is directed to a heat pump system and more particularly to a self-contained heat pump capable of heating potable water, air conditioning, heating and dehumidification.

2. Description of the Prior Art

Presently, a conventional heat pump involves the process of transferring heat from a low-temperature reservoir to a higher temperature reservoir, expending mechanical energy in the process. To accomplish the transfer of heat, a cycle of evaporation, compression, condensation and expansion is performed on a heat-transfer medium operating within the heat pump.

A temperature reservoir of the heat pump may include such varied external sources as the air, water, earth, solar energy, or waste heat. The selection of the external source of the temperature reservoir is dependent upon the prevailing climate, topography and performance characteristics desired from the heat pump. For example, air is plentiful and easily available but heat pump output capacity and efficiency decreases as the heating requirements increase and the outdoor temperature drops.

It will be appreciated that conventional heat pump units are designed to utilize the same components in the operation of the cooling cycle and heating cycle.

Operation of the heat pump in the heating cycle begins as the heat-transfer medium, usually refrigerant, enters a compressor as a vapor. The vapor is pressurized in the compressor resulting in an increase in temperature. The heated vapor then is transferred to a condenser, also known as a refrigerant-air heat exchanger, heat is then removed from the refrigerant and transferred to a cooler conditioned space. Here the vapor condenses as it is cooled by the conditioned space and leaves as a high pressure liquid. The liquid refrigerant then flows through a refrigerant-flow restrictor and into a low pressure area. The reduction in pressure causes the liquid to partially vaporize and drop in temperature. The low temperature liquid-vapor mixture then flows through an evaporator, also known as an external source-refrigerant heat exchanger, where heat is absorbed from the external source. The liquid-vapor refrigerant mixture evaporates into a vapor as heat is absorbed. Now as a vapor, the refrigerant is returned to the compressor and the heating cycle is repeated.

The heat pump may be adjusted from the heating cycle to the cooling cycle by the use of a reversing valve at the discharge of the compressor. By switching the direction of flow of refrigerant, the role of the evaporator and condenser are effectively reversed resulting in cool refrigerant flowing to the evaporator to absorb heat from the conditioned space.

To provide the added capability of potable water heating, conventional heat pumps typically incorporate an additional refrigerant-potable water heat exchanger. The additional heat exchanger is added between the compressor and reversing valve. With the potable water-refrigerant heat exchanger in this position, the highest temperature refrigerant is always provided to heat potable water.

The disadvantage of these types of heat pump systems are that water heating can occur only when the heat pump is operating in either the heating or cooling cycle. It will be appreciated that in most climates heating and cooling occur only half of the time during the course of a year. Therefore, if the heating and cooling requirements are satisfied, the heat pump is not operating and hot potable water is not being produced.

Another disadvantage of the previously-known heat pump systems with potable hot water capability is that the amount of heat available for heating the conditioned space is reduced when the heat pump must simultaneously provide potable hot water heating and conditioned space heating. Most of the heat available in the hot vapor refrigerant is absorbed by the potable hot water heating system. Therefore, to provide adequate potable hot water heating capability and conditioned space heating, the compressor unit must be oversized resulting in an inefficient heat pump unit.

It is an object of the present invention to provide a unitary, self-contained, efficient heat pump system with full-time potable hot water capability. It is another object of the present invention to provide an efficient heat pump system capable of heating potable water, air conditioning, heating and dehumidification. It is yet another object of the present invention to provide an efficient heat pump system incorporating new functional systems to allow for two stages of heating, two stages of air conditioning, dehumidification, and potable water heating.

Other objects and advantages of the invention will become more apparent during the course of the following description when taken in connection with the accompanying drawings.

SUMMARY OF THE INVENTION

In accordance with this invention, the objects and advantages of this invention are achieved by providing a heat pump unit for heating or cooling a conditioned space with potable water heating capability. The heat pump unit has a compressor with a service port, an entrance port and a discharge. A three-way valve is provided connected to the discharge and to the service port of the compressor, and a reversing valve is connected to the three-way valve and to the compressor entrance port. A refrigerant-air heat exchanger is connected to the reversing valve outlet and an external source-refrigerant heat exchanger is connected to the reversing valve with a refrigerant-potable water heat exchanger connected to the three-way valve.

The heat pump unit also includes a refrigerant-control device interposed between the external source-refrigerant heat exchanger and the refrigerant-air heat exchanger, a first bi-flow valve interposed between the refrigerant-control device and the refrigerant-potable water heat exchanger, and a second bi-flow valve interposed between the refrigerant-control device and the refrigerant-air heat exchanger. The refrigerant-potable water heat exchanger produces hot water irregardless of the heating or cooling operation of the heat pump.

DESCRIPTION OF THE PREFERRED EMBODIMENTS

Figure 1:
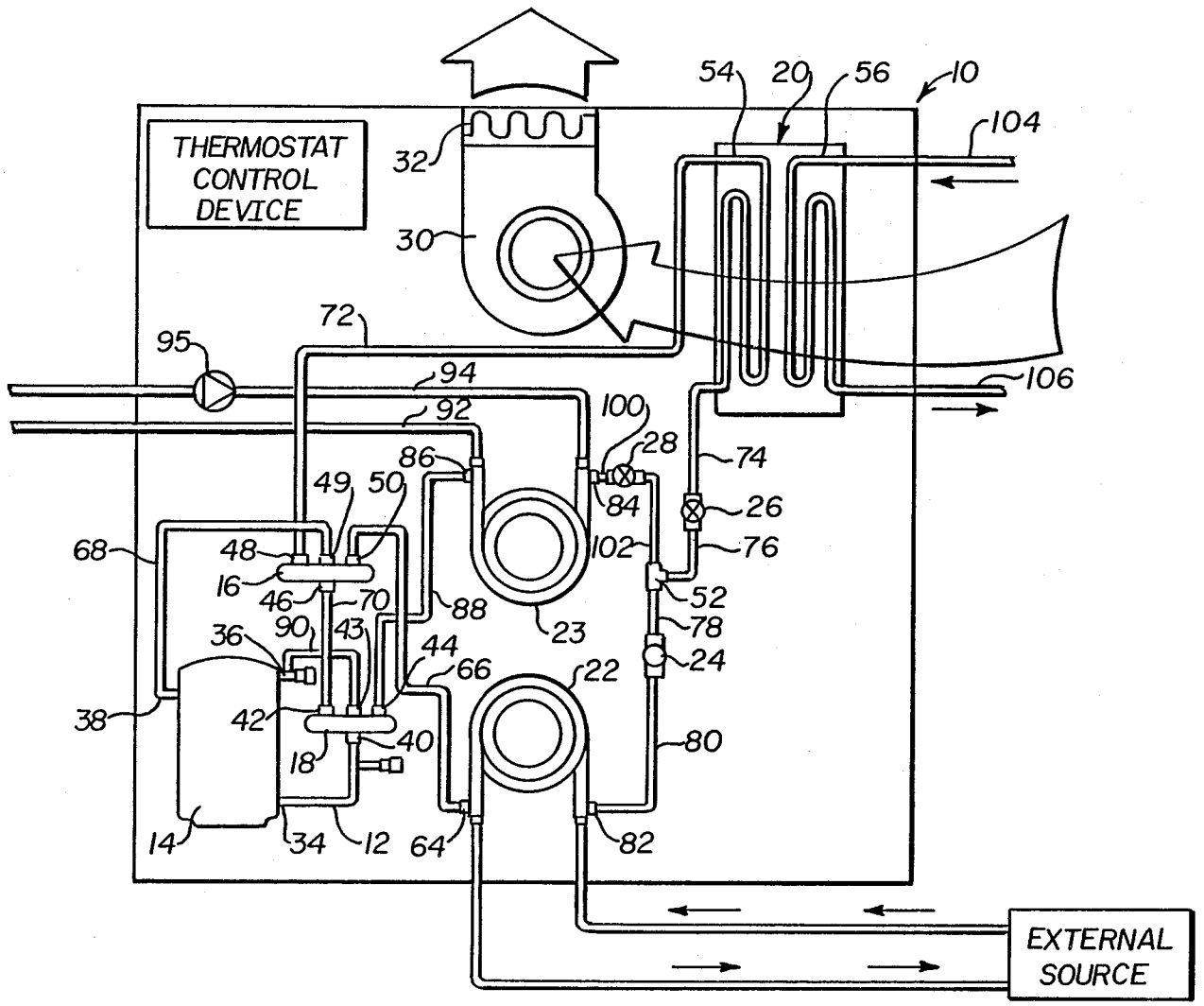
FIG. 1 is a diagram of the heat pump of the present invention.

Referring now to the drawings wherein like reference characters represent like elements, FIGS. 1–4 and 6–7 illustrate the heat pump unit 10 with potable water heating capability.

The heat pump unit includes a system of piping interconnecting a compressor 14, refrigerant-air heat exchanger 20, external source-refrigerant heat exchanger 22, refrigerant-potable water heat exchanger 23, refrigerant-control device 24, and a valve means for circulating refrigerant from the potable water heating cycle position to the heating and cooling cycle position in cooperation with a blower 30, electric resistance heating elements 32 and thermostat control. The valve means includes a reversing valve 16, a three-way valve 18, a first bi-flow valve 26 and a second bi-flow valve 28 for circulating the refrigerant. The individual components making up the heat pump are of a type and design commonly used in conventional heat pump units. In a preferred embodiment, the first bi-flow valve 26 and second bi-flow valve 28 are solenoid bi-flow valves.

Because of the overall design of the present unit, the compressor size may be substantially reduced while not affecting the amount of heating, cooling and potable water heating produced when compared to conventional heat pump units. Moreover, the heat pump unit of the present invention is capable of continuously providing hot potable water and heat or air conditioning irregardless of whether the thermostat control calls for either the heating cycle or cooling cycle.

As shown in FIG. 1, the compressor 14 includes a discharge port 34, a service port 36 and an entrance port 38. The discharge port is connected to a three-way valve 18 through first inlet port 40. The three-way valve includes three ports 42, 43 and 44. Port 42 of the three-way valve 18 is connected to the reversing valve 16 through a second inlet port 46. Port 43 of the three-way valve is connected to the service port 36 of the compressor 14. Port 44 is connected to the refrigerant-potable water heat exchanger 23. The reversing valve also includes three orifices 48, 49 and 50. Orifice 48 is connected to a refrigerant-air coil 54 of the refrigerant-air heat exchanger 20. Orifice 49 is connected to the entrance port 38 of the compressor 14, and orifice 50 is connected to the external source-refrigerant heat exchanger 22. The refrigerant-air coil 54 of the refrigerant-air heat exchanger 20 is connected to a first bi-flow valve 26 which in turn is connected to a first end of a T-pipe fitting 52. The external source-refrigerant heat exchanger 22 is also connected to a second end of T-pipe fitting 52 via the refrigerant-control device 24. The refrigerant-potable water heat exchanger 23 is connected to a second bi-flow valve 28 which is connected to the third end of T-pipe fitting 52. From the interconnection of the components of the heat pump, three separate circuits formed of a heating cycle, a cooling cycle and a potable water heating cycle may be operatively controlled by the thermostat control.

More particularly, the thermostat control of the heat pump may respond to either the temperature in the conditioned space, the hot water temperature or a time clock for selecting the mode of operation. For example, if the heat pump system is heating or cooling the conditioned space and the temperature of the hot water drops below a predetermined value, the heat pump immediately switches to water heating and shuts off the blower 30. The potable water is then heated back up to the predetermined value as previously described. The heat pump then switches back to either the heating or cooling cycle provided the thermostat device is still calling for heating or cooling. If while heating the potable hot water the room temperature drops below a predetermined value, the heat pump switches back to the heating cycle and an electric resistance backup heater 32 superimposed in front of the blower 30 is activated along with the heat pump to heat the conditioned space until the temperature of the conditioned space recovers to the predetermined room thermostat set point. During periods when either heating or cooling are not required, the heat pump operates solely in response to the temperature of the potable water. Thus hot potable water is continuously available irregardless of whether heating or cooling of the conditioned space is called for.

In the heating cycle, the moment the thermostat control calls for heat, the compressor 14 is activated. As the compressor begins operating, a decrease in refrigerant suction pressure in the pipe 66 and 68 connecting the compressor and external source-refrigerant heat exchanger 22 causes low temperature refrigerant to enter the external source-refrigerant heat exchanger 22 and absorb heat from the higher temperature external source.

Figure 7:
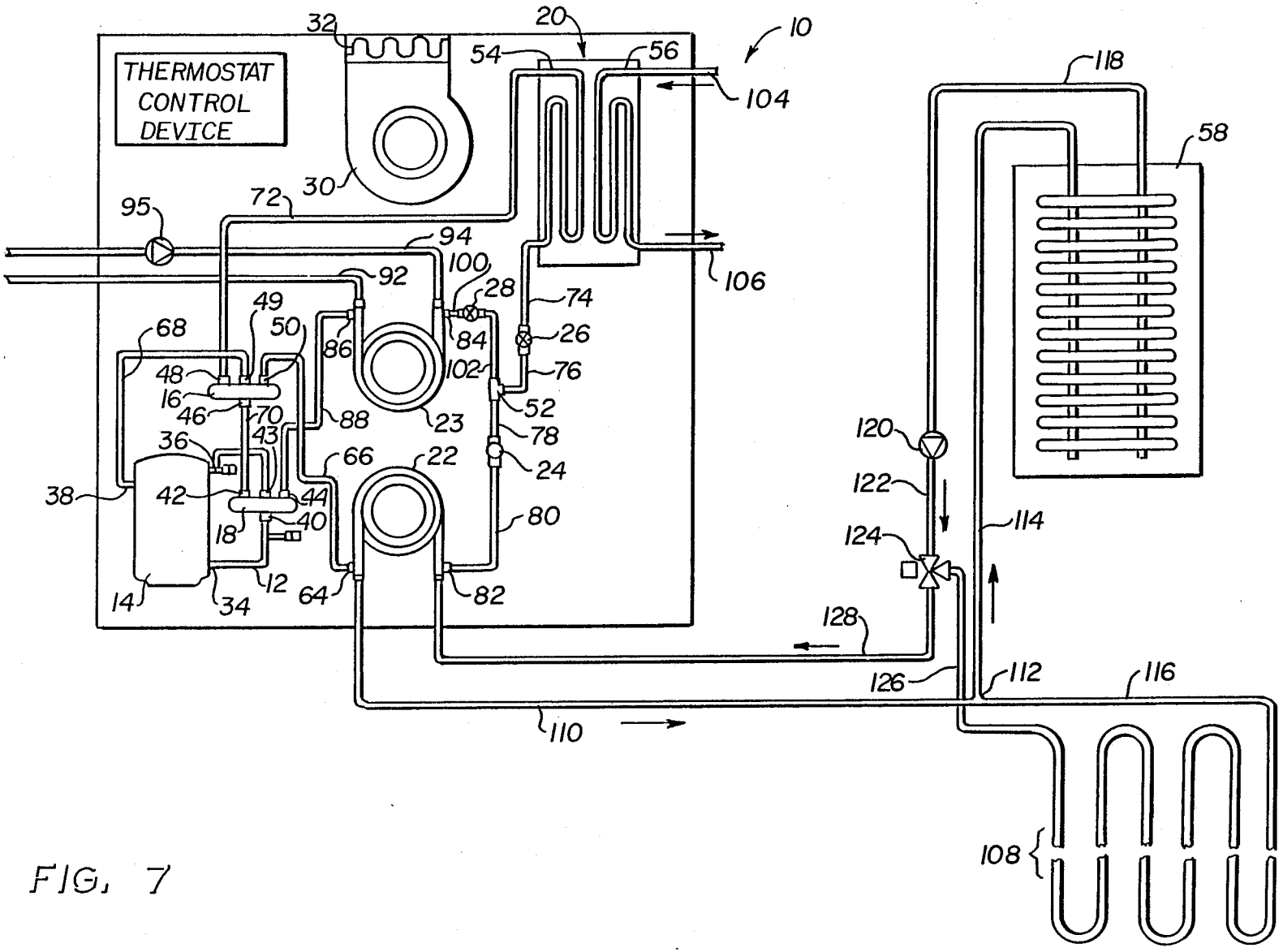
FIG. 7 is a diagram of the heat pump of the present invention including a thermal storage tank and ground loop.

As shown in FIGS. 1–4 and 7, the external source-refrigerant heat exchanger 22 is a tube-in-tube heat exchanger wherein the refrigerant flows counter to the flow of the external source in the outer tube. As used herein, "external source" refers to the external source providing thermal energy for use in the heat pump of the present invention. Various external sources of thermal energy available for use in the present invention include well water, air, lake or pond water, water circulated within a closed ground loop, and solar energy and the like. FIG. 7 illustrates the use of a thermal storage tank 58 and ground loop 108 in combination as an external source.

As shown in FIG. 7, a thermal storage tank 58 and ground loop 108 are combined as an external source. A transfer medium, typically an antifreeze solution such as ethylene glycol and the like, is circulated from the refrigerant-liquid heat exchanger 22 via pipe 110 to a T-pipe fitting 112. From the T-pipe fitting, the transfer medium may flow either to the thermal storage tank 58 or to the ground loop 108 through pipes 114 and 116, respectively. From the thermal storage tank, the transfer medium is drawn through pipe 118 by circulating pump 120. The medium flows from circulating pump 120 and pipe 122 to a third three-way valve 124. Also, connected to valve 124 is pipe 126 which in turn is connected to ground loop 108, and pipe 128 which is connected to the external source-refrigerant heat exchanger 22. Three-way valve 124, when open, allows medium from the storage tank to mix with medium from the ground loop and flow from pipe 128 to heat exchanger 22 and when closed, prevents mixing of the ground loop medium and storage tank medium so that only medium from the storage tank flows to the heat exchanger. It will be appreciated that the temperature of the medium used in the external source-refrigerant heat exchanger 22 may be adjusted by mixing of the medium in the ground loop and storage tank.

Figure 6:
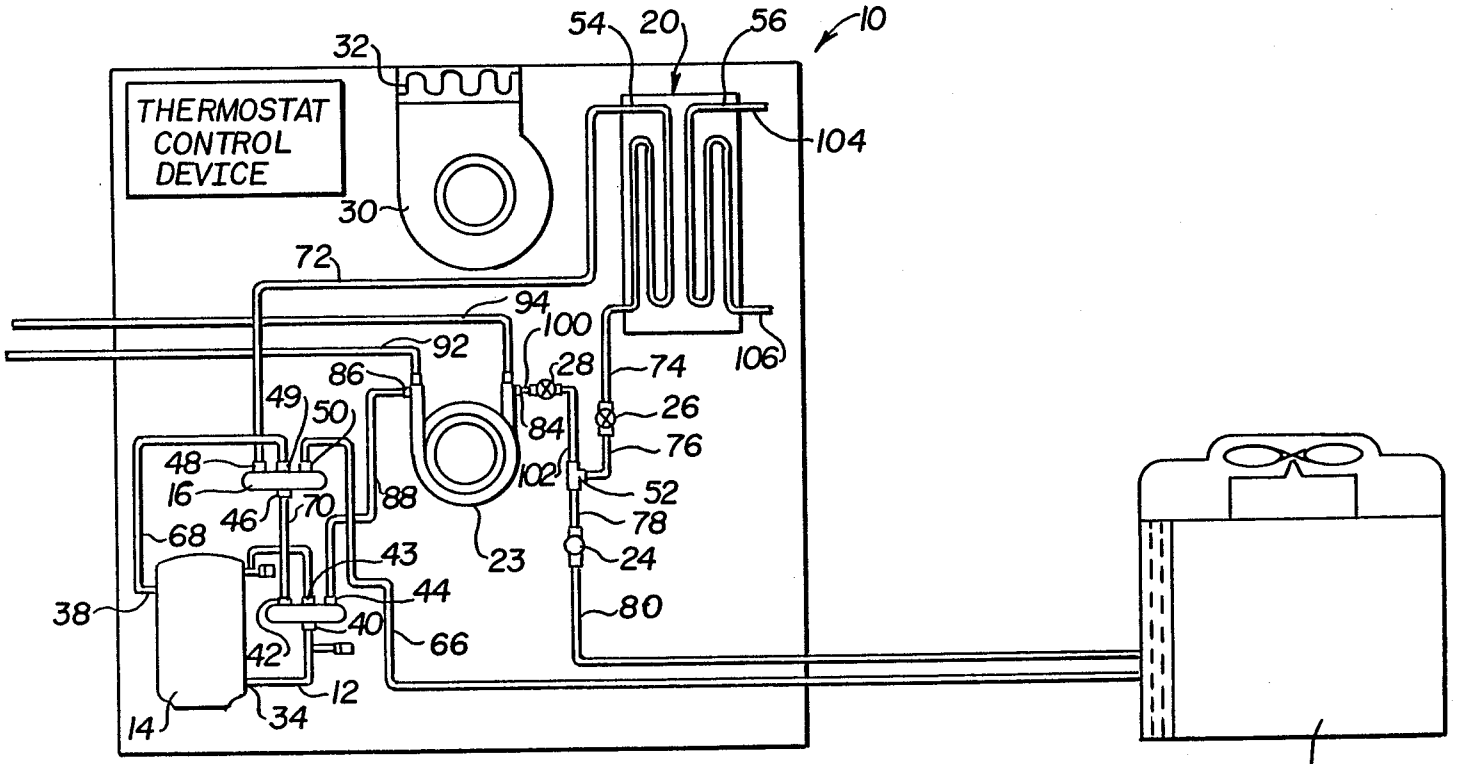
FIG. 6 is a diagram of the heat pump of the present invention including an external source-refrigerant heat exchanger positioned outside the heat pump.

The external source may either flow directly in the inner tube or the external source may be transferred to a medium that flows in the inner tube. For example, conventional air-to-air heat pumps transfer thermal energy from the air to a refrigerant medium. As shown in FIG. 6, the external source-refrigerant heat exchanger is positioned outside of the heat pump unit such that the thermal energy from the surrounding air is transferred directly to the refrigerant.

Since in the heating mode the refrigerant in the external source-refrigerant heat exchanger 22 is under low pressure and low temperature, the refrigerant absorbs the heat from the higher temperature external source. The vaporized refrigerant exits exchanger 22 at fitting 64 and is then drawn through pipe 66, orifice 50 to reversing valve 16. From reversing valve 16, the refrigerant is directed through orifice 49 via pipe 68 and into the compressor 14 through the entrance port 38 where it is compressed and increased in temperature. The refrigerant-vapor then exits the compressor through the discharge port 34 and flows through pipe 12 to the three-way valve 18 through outlet port 42, pipe 70 to enter reversing valve 16 at inlet port 46. The refrigerant leaves the reversing valve 16 via orifice 48 and travels through a pipe 72 to enter the refrigerant-air coil 54 of the heat exchanger 20 where the refrigerant is condensed into a liquid at high pressure. Cool air from the conditioned space is heated by blowing the cool air across the refrigerant-air heat exchanger by the blower 30 as shown by the arrow in FIG. 1. The slightly warmer high pressure liquid refrigerant leaves the refrigerant-air coil 54 and is then passed by way of pipe 74 through an open first bi-flow valve 26. The refrigerant then flows from open bi-flow valve 26 through pipe 76 to T-pipe fitting 52. From T-pipe fitting 52 the refrigerant is directed through a refrigerant-control device 24 via pipe 78. It will be appreciated that when the heat pump unit 10 is operating in the heating cycle or cooling cycle bi-flow valve 28 is closed. Therefore, the refrigerant must flow from T-pipe fitting 52 to the refrigerant-control device 24 as opposed to refrigerant-potable water heat exchanger 23. The refrigerant-control device 24 causes a reduction in temperature and pressure of the refrigerant resulting in partial vaporization of the liquid refrigerant. The liquid vapor-refrigerant mixture exiting refrigerant-control device 24, returns to the external source-refrigerant heat exchanger 22 through fitting 82 and pipe 80 to begin the heating cycle again. Once the desired temperature in the conditioned space is reached, a signal is sent by the thermostat control to the compressor to stop.

In the cooling cycle, the thermostat control responds to a temperature rise in the conditioned space to activate the compressor 14. With the compressor operating, the cold, low pressure liquid refrigerant in the coil 54 of the refrigerant-air heat exchanger 20 begins to absorb heat from air blown through the refrigerant-air heat exchanger by blower 30. Thus, the refrigerant is converted to a cool vapor. The vaporized refrigerant is then drawn through pipe 72 and orifice 48 to the reversing valve 16. From orifice 49 of valve 16 the refrigerant flows through pipe 68 to entrance port 38 to the compressor 14 where it is compressed and heated and then discharged through the discharge port 34 to the three-way valve 18 via pipe 12 and first inlet port 40. The refrigerant passes by way of exit port 42, pipe 70 and second inlet port 46 back through the reversing valve 16 and then through orifice 50, pipe 66 and fitting 64 to the external source-refrigerant heat exchanger 22. The hot, vaporized refrigerant condenses into a warm liquid as the refrigerant is cooled by the lower temperature external source of the external source-refrigerant heat The high pressure warm liquid refrigerant then exits heat exchanger 22, fitting 82 and passes through the refrigerant-control device 24 via pipe 80. Within the control device, the warm liquid refrigerant is converted into a cold liquid refrigerant. Next, the cold liquid refrigerant flows from device 24 through pipe 78 to T-pipe fitting 52. The refrigerant is then directed through pipe 76 to the first bi-flow valve 26 and then to the refrigerant-air coil 54 of the heat exchanger 20 where warm air from the conditioned space is again blown over the refrigerant-air heat exchanger. The vaporized refrigerant is then returned to the compressor via reversing valve 16, to begin the cooling cycle again. In the cooling cycle, the direction of flow of refrigerant within the external source-refrigerant heat exchanger 22 and refrigerant-air coil 54 of exchanger 20 is reversed from that of the heating cycle by reversing valve 16 directing refrigerant through orifice 50 instead of orifice 48.

During the start up of the compressor 14 in the heating and cooling cycle, the second bi-flow valve 28 is closed and the suction formed at the entrance port 38 of the compressor completely evacuates the refrigerant from the refrigerant-potable water heat exchanger 23 and pipe 88 into exit port 44 of the three-way valve 18 and out exit port 43 through pipe 90 for use in either the heating or cooling cycle. Accordingly, no reservoir of refrigerant is accumulated by the refrigerant-potable water heat exchanger 23 and pipe 88 thereby assuring an adequate supply of refrigerant in the heat pump unit when operating in either the heating or cooling cycle.

Figure 2:
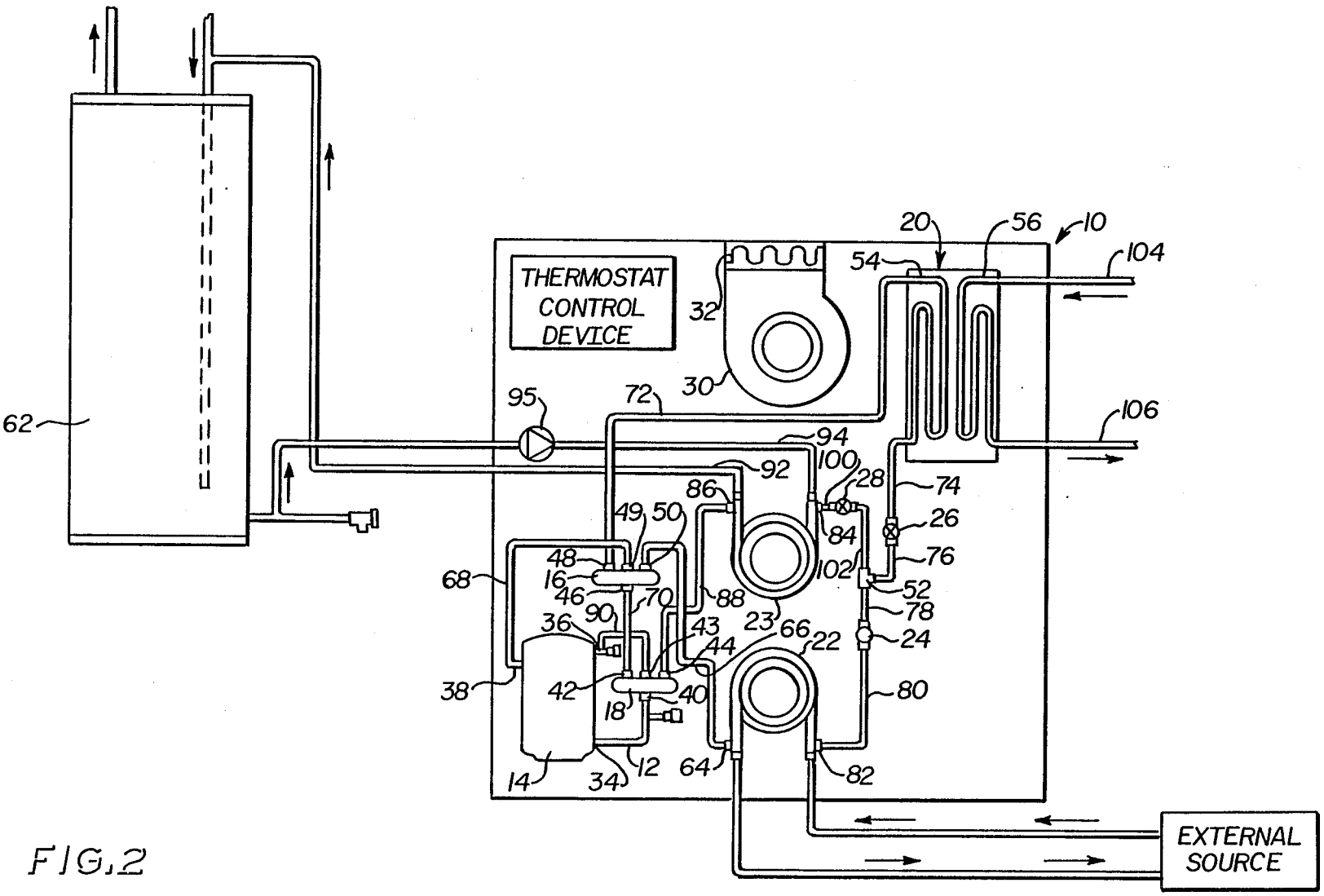
FIG. 2 is a diagram of the heat pump of the present invention including a hot water storage tank.

In the hot water heating cycle, the compressor 14 compresses the refrigerant into a hot vapor which is then discharged via discharge port 34 through pipe 12, first inlet port 40 to the three-way valve 18 where the refrigerant is directed to the refrigerant-potable water heat exchanger 23 by way of port 44, pipe 88 and fitting 86. In a preferred embodiment, the potable water heat exchanger 23 is a tube-in-tube heat exchanger of double-wall construction, wherein the refrigerant flows counter to the flow of water in the inner tube supplied through pipe 94 and returned through pipe 92. The hot vapor refrigerant passes heat to the water and thereby condenses in the refrigerant-potable water heat exchanger 23. The hot water is then piped outside the heat pump unit through pipe 92 for a variety of domestic uses. As shown in FIG. 2, the hot water may be piped to a hot water storage tank 62 by circulating pump 95.

Figure 3:
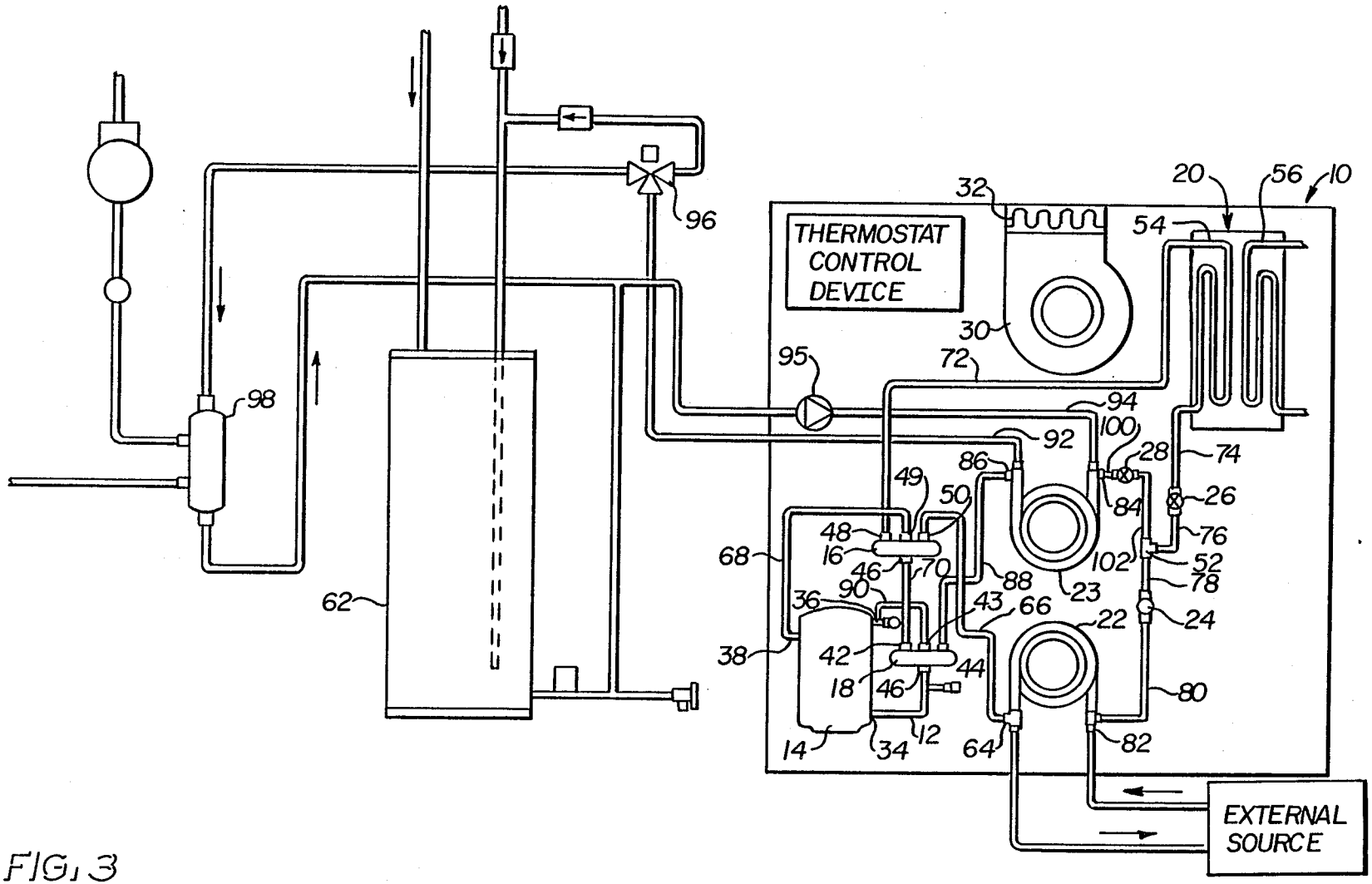
FIG. 3 is a diagram of the heat pump of the present invention including a hot water storage tank and a pool water heater.

It will be appreciated that hot water may also be piped to any number of external heat exchangers to provide additional heating capability. As shown in FIG. 3, hot water is piped through a second three-way valve 96 to a hot water storage tank 62 and a water-water heat exchanger 98. The heat exchanger 98, of conventional design, may provide heated water for additional secondary uses such as a pool or a spa.

The condensed warm liquid refrigerant flows from refrigerant-potable water heat exchanger 23 through fitting 84, pipe 100, second bi-flow valve 28, pipe 102, T-pipe fitting 52, and pipe 78 to the refrigerant-control device 24. The refrigerant-control device converts the warm liquid refrigerant to a cold liquid by rapid expansion of the refrigerant from a high pressure area to a low pressure area. The cold liquid refrigerant exiting from control device 24 then passes through pipe 80, fitting 82 to the external source-refrigerant heat exchanger 22 where heat is absorbed from the warmer external source causing the liquid refrigerant to vaporize. The now cool refrigerant vapor enters the reversing valve 16 through fitting 64, pipe 66 and orifice 50 and is directed back to the compressor via orifice 49, pipe 68 and entrance port 38, and the cycle is repeated.

During the start-up of the compressor in the hot water heating cycle the entrance port 38 of the compressor 14 evacuates the refrigerant from the piping 74, 70, and 72 extending between first bi-flow valve 26, through the refrigerant-air coil 54 of the refrigerant-air heat exchanger 20 and reversing valve 16 to the compressor for use in the hot water heating cycle. The independent opening and closing of the first and second bi-flow valves 26 and 28 allow for the evacuation of refrigerant from the coil 54 of the refrigerant-air heat exchanger 20 when the temperature control device does not call for the heat pump to operate in either the heating or cooling cycle thereby assuring an adequate supply of refrigerant in the potable water heating cycle.

Figures 4, 5:
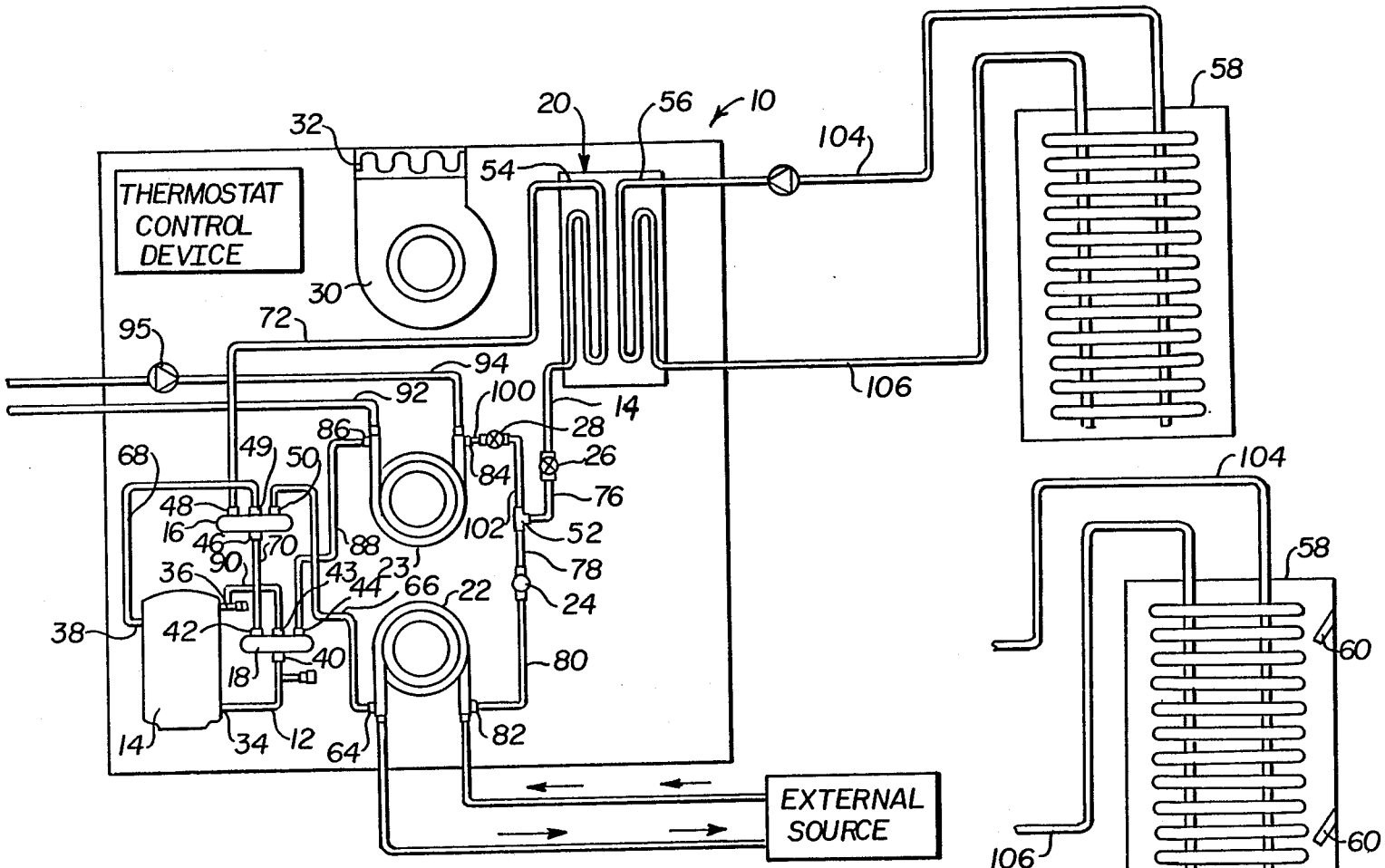
FIG. 4 is a diagram of the heat pump of the present invention including a thermal storage tank.
FIG. 5 is a thermal storage tank with electric resistance heating elements.

In a preferred embodiment, the refrigerant-air heat exchanger incorporates two separate coils, a refrigerant-air coil 54 and a liquid-air coil 56. The pair of separate coils allow for different modes of off-peak operation as shown in FIGS. 4 and 6. Off-peak operation, as used herein, refers to that period of time when utility rates are lowest due to low demand.

FIG. 4 illustrates the heat pump unit operating in the off-peak hot water storage mode. The off-peak hot water storage mode includes a thermal liquid storage tank 58 connected to the liquid-air coil 56 of the refrigerant-air heat exchanger 20 by way of supply line 104 and return line 106. As shown in FIG. 5, a plurality of electric resistance heating elements 60 may be positioned within the thermal storage tank to heat the liquid contained therein. In a preferred embodiment, the liquid consists of a antifreeze mixture that does not freeze when the ambient temperature is below freezing. The liquid is heated by the electrical resistance heating elements 60 during off-peak hours. When called for by the thermostat control, the liquid is circulated through supply line 104 to the liquid-air coil 56 of the refrigerant-air heat exchanger 20 and air from the conditioned space is blown over the liquid-air coil resulting in a transfer of heat to the conditioned space without the necessity of operating the compressor of the heat pump unit. The now cool liquid is returned to the storage tank 58 via return line 106.

An off-peak ice storage capability added to the heat pump unit is also shown in FIG. 4. The off-peak ice storage is provided by the operation of the heat pump in the cooling cycle as previously described during off-peak hours without the use of the fan. In the cooling cycle, cold liquid refrigerant in the refrigerant-air coils 54 of the heat exchanger 20 chills the liquid within the liquid-air circuit 56. The cold liquid is then stored in the thermal storage tank 58 until needed. The cold liquid, when the cycle is called for by the thermostat control, is circulated from tank 58 through supply line 104 to the liquid-air circuit 56 of the refrigerant-air heat exchanger 20 where warm air from the conditioned space is blown through the refrigerant-air heat exchanger to cool the conditioned space. The warm liquid is then returned to the tank 58 via return line 106.

The use of either the off-peak heating or cooling cycle of the heat pump results in increased savings to the consumer due to the capability of storing the heated or cooled liquid produced by the heat pump utilizing low utility rates.

Having described presently preferred embodiments of the invention, it is to be understood that it may be otherwise embodied within the scope of the appended claims.

I claim:

1. An improved heat pump unit for heating and cooling a conditioned space utilizing a recirculating refrigerant with potable water heating capability, said heat pump unit of the type having a compressor, a refrigerant-air heat exchanger, an external source-refrigerant heat exchanger interconnected to recirculate refrigerant and transfer heat from a low temperature reservoir to a higher temperature reservoir, wherein the improvement comprises:

a refrigerant-potable water heat exchanger adapted to be connected to a reservoir of potable water through inlet and outlet pipes for passage of potable water therethrough;

a valve means, when positioned for a potable water heating cycle, for evacuating refrigerant from said refrigerant-air heat exchanger and for circulating refrigerant from the compressor to said refrigerant-potable water heat exchanger to heat potable water passing therethrough, and for then circulating said refrigerant to the external source-refrigerant heat exchanger for return to said compressor, and when positioned for a cooling cycle, for evacuating refrigerant from said refrigerant-potable water heat exchanger and for circulating refrigerant from said compressor to the external source-refrigerant heat exchanger and then to the refrigerant-air heat exchanger for return to the compressor; and when positioned for a heating cycle, for evacuating refrigerant from said refrigerant-potable water heat exchanger and for circulating refrigerant from said compressor to the external source-refrigerant heat exchanger and then to the refrigerant-air heat exchanger for return to the compressor; and a thermostat control device responsive to a temperature of the potable water reservoir and conditioned space for activation of said valve means from said hot potable water heating cycle position to said heating and cooling cycle position.

2. The improved heat pump unit as set forth in claim 1 wherein the circulating valve means comprises a three-way valve, a reversing valve, a first bi-flow valve and a second bi-flow valve, wherein said three-way valve is connected to said compressor, said reversing valve is connected to said three-way valve and to said compressor, said first bi-flow valve is interposed between the external source-refrigerant heat exchanger and the refrigerant-air heat exchanger and said second bi-flow valve is interposed between the external source-refrigerant heat exchanger and the refrigerant-potable water heat exchanger to form a heating cycle, a cooling cycle and a potable-water heating cycle.

3. The improved heat pump unit as set forth in claim 2, further comprising a refrigerant-control device, said refrigerant-control device interposed between the external source-refrigerant heat exchanger and said first and said second bi-flow valves, said refrigerant-control device cooling the refrigerant as the refrigerant flows therethrough.

4. The improved heat pump unit as set forth in claim 1 further comprising a circulating pump and a hot water storage tank for the reservoir of potable water, said storage tank connected to the refrigerant-potable water heat exchanger through inlet and outlet pipes for passage of potable water circulated therethrough by said circulating pump.

5. The improved heat pump unit as set forth in claim 1 further comprising a second three-way valve, a hot water storage tank, a circulating pump and a water-water heat exchanger, said circulating pump forcing potable water through said second three-way valve and to said hot water storage tank and to said water-water heat exchanger, wherein said water-water heat exchanger heats water for secondary use.

6. The improved heat pump unit as set forth in claim 1 wherein said refrigerant-air heat exchanger includes a refrigerant-air coil and a liquid-air coil, said refrigerant-air coil for heating and cooling air blown from the conditioned space over said refrigerant-air coil and for heating and cooling said liquid-air coil.

7. The improved heat pump unit as set forth in claim 6 further comprising a liquid and a thermal liquid storage tank for storing liquid heated and cooled within said liquid-air coil said storage tank connected to said liquid-air coil through return and supply lines for storage of heated and cooled liquid therein.

8. The improved heat pump unit as set forth in claim 7 further comprising electric resistance heating elements, said heating elements positioned within said storage tank for heating said liquid within said storage tank.

9. The improved heat pump unit as set forth in claim 7 wherein said liquid is an antifreeze solution.

10. The improved heat pump unit as set forth in claim 9 wherein said antifreeze solution is ethylene glycol.

11. The improved heat pump unit as set forth in claim 7 further comprising a circulating pump, said circulating pump provided within the supply line for circulating liquid between the storage tank and liquid-air coil.

12. The improved heat pump unit as set forth in claim 1 wherein said external source of said external source-refrigerant heat exchanger is air.

13. The improved heat pump unit as set forth in claim 1 wherein said external source of said external source-refrigerant heat exchanger is a liquid source, said heat exchanger transferring heat between said liquid source and said refrigerant.

14. The improved heat pump unit as set forth in claim 13 wherein said liquid source is water.

15. The improved heat pump unit as set forth in claim 13 wherein said liquid source is an antifreeze solution.

16. The improved heat pump unit as set forth in claim 15 wherein said antifreeze solution is ethylene glycol.

17. The improved heat pump unit as set forth in claim 13 further comprising a thermal liquid storage tank, a ground loop, a third three-way valve and a circulating pump, said liquid source circulated between said external source-refrigerant heat exchanger, said ground loop and said thermal storage tank by said circulating pump through said third three-way valve.

18. A heat pump unit for heating and cooling a conditioned space utilizing a recirculating refrigerant, with potable water heating capability comprising:

a compressor, including a service port, an entrance port and a discharge;

a refrigerant-air heat exchanger;

an external source-refrigerant heat exchanger;

a refrigerant-potable water heat exchanger;

a refrigerant-control device interposed between said external source-refrigerant heat exchanger and said refrigerant-air heat exchanger;

a valve means, when positioned for a potable water heating cycle, for evacuating refrigerant from said refrigerant-air heat exchanger and for circulating refrigerant from the compressor to said refrigerant-potable water heat exchanger to heat potable water passing therethrough, and for circulating said refrigerant to the external source-refrigerant heat exchanger for return to said compressor, and when positioned for a cooling cycle, for evacuating refrigerant from said refrigerant-potable water heat exchanger and for circulating refrigerant from said compressor to the external source-refrigerant heat exchanger and then to the refrigerant-air heat exchanger for return to the compressor; and when positioned for a heating cycle, for evacuating refrigerant from said refrigerant-potable water heat exchanger and for circulating refrigerant from said compressor to the refrigerant-air heat exchanger and then to the external source-refrigerant heat exchanger for return to the compressor; and a thermostat control device responsive to a temperature of the potable water reservoir and conditioned space for activation of said valve means from said hot potable water heating cycle position to said heating and cooling cycle position.

19. The heat pump unit as set forth in claim 18 wherein the circulating valve means comprises a three-way valve, a reversing valve, a first bi-flow valve and a second bi-flow valve, wherein said three-way valve is connected to said compressor, said reversing valve is connected to said three-way valve and to said compressor, said first bi-flow valve is interposed between the external source-refrigerant heat exchanger and the refrigerant-air heat exchanger and said second bi-flow valve is interposed between the external source-refrigerant heat exchanger and the refrigerant-potable water heat exchanger to form a heating cycle, a cooling cycle and a potable-water heating cycle.

20. The heat pump unit as set forth in claim 19, further comprising a refrigerant-control device, said refrigerant-control device interposed between the external source-refrigerant heat exchanger and said first and second bi-flow valves, said refrigerant-control device cooling the refrigerant as the refrigerant flows therethrough.

21. The heat pump unit as set forth in claim 20 further comprising a circulating pump and a hot water storage tank for the reservoir of potable water, said storage tank connected to the refrigerant-potable water heat exchanger through inlet and outlet pipes for passage of potable water circulated therethrough by said circulating pump.

22. The heat pump unit as set forth in claim 21 further comprising a second three-way valve, a hot water storage tank, a circulating pump and a water-water heat exchanger, said circulating pump forcing potable water through said second three-way valve and to said hot water storage tank and to said water-water heat exchanger, wherein said water-water heat exchanger heats water for secondary use.

23. The heat pump unit as set forth in claim 22 wherein said refrigerant-air heat exchanger includes a refrigerant-air coil and a liquid-air coil, said refrigerant-air coil for heating and cooling air blown from the conditioned space over said refrigerant-air coil and for heating and cooling said liquid-air coil.

24. The heat pump unit as set forth in claim 23 further comprising a liquid and a thermal liquid storage tank for storing liquid heated and cooled within said liquid-air coil, said storage tank connected to said liquid-air coil through return and supply lines for storage of heated and cooled liquid therein.

25. The heat pump unit as set forth in claim 24 further comprising electric resistance heating elements, said heating elements within said storage tank for heating said liquid within said storage tank.

26. The heat pump unit as set forth in claim 25 wherein said liquid is an antifreeze solution.

27. The improved heat pump unit as set forth in claim 26 wherein said antifreeze solution is ethylene glycol.

28. The heat pump unit as set forth in claim 26 further comprising a circulating pump, said circulating pump provided within the supply line for circulating liquid between the storage tank and liquid-air coil.

29. The heat pump unit as set forth in claim 28 wherein said external source of said external source-refrigerant heat exchanger is air.

30. The heat pump unit as set forth in claim 29 wherein said external source of said external source-refrigerant heat exchanger is a liquid source, said heat exchanger transferring heat between said liquid source and said refrigerant.

31. The heat pump unit as set forth in claim 30 wherein said liquid source is water.

32. The heat pump unit as set forth in claim 31 wherein said liquid source is an antifreeze solution.

33. The heat pump unit as set forth in claim 32 wherein said antifreeze solution is ethylene glycol.

34. The heat pump unit as set forth in claim 32 further comprising a thermal liquid storage tank, a ground loop, a third three-way valve and a circulating pump, said liquid source circulated between said external source-refrigerant heat exchanger, said ground loop and said thermal storage tank by said circulating pump through said third three-way valve.

* * * * *

UNITED STATES PATENT AND TRADEMARK OFFICE

CERTIFICATE OF CORRECTION

PATENT NO. : 4,856,578

DATED : August 15, 1989

INVENTOR(S) : David I. McCahill

It is certified that error appears in the above-identified patent and that said Letters Patent is hereby corrected as shown below:

Column 6 Line 10 after "heat" insert --exchanger 22.--.

Signed and Sealed this

Tenth Day of July, 1990

*Attest:*

HARRY F. MANBECK, JR.

*Attesting Officer*

*Commissioner of Patents and Trademarks*